US007325414B2

(12) United States Patent
Taras et al.

(10) Patent No.: US 7,325,414 B2
(45) Date of Patent: Feb. 5, 2008

(54) HYBRID TANDEM COMPRESSOR SYSTEM WITH ECONOMIZER CIRCUIT AND REHEAT FUNCTION FOR MULTI-LEVEL COOLING

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 366 days.

(21) Appl. No.: 10/975,802

(22) Filed: Oct. 28, 2004

(65) Prior Publication Data

US 2006/0090502 A1 May 4, 2006

(51) Int. Cl.
*F25B 1/00* (2006.01)

(52) U.S. Cl. ..... 62/510

(58) Field of Classification Search ..... 62/510, 62/512

See application file for complete search history.

(56) References Cited

U.S. PATENT DOCUMENTS 4,947,655 A * 8/1990 Shaw ..... 62/200
6,381,970 B1 * 5/2002 Eber et al. ..... 62/90
6,860,116 B2 * 3/2005 Lifson et al. ..... 62/498
7,059,151 B2 * 6/2006 Taras et al. ..... 62/513
7,131,285 B2 * 11/2006 Lifson et al. ..... 62/196.4
2005/0150248 A1 * 7/2005 Manole ..... 62/513
2005/0166620 A1 * 8/2005 Bussjager ..... 62/196.4
2006/0010907 A1 * 1/2006 Taras et al. ..... 62/513
2006/0053822 A1 * 3/2006 Taras et al. ..... 62/324.1
2006/0080984 A1 * 4/2006 Lifson et al. ..... 62/228.5
2006/0090501 A1 * 5/2006 Taras et al. ..... 62/504

* cited by examiner

*Primary Examiner*—Melvin Jones
(74) *Attorney, Agent, or Firm*—Carlson, Gaskey & Olds

(57) ABSTRACT

A tandem compressor refrigerant system where an economizer circuit and reheat coil are incorporated to provide additional flexibility and control over overall system capacity and sensible heat ratio as well as to increase system efficiency. In this system, tandem compressors deliver compressed refrigerant to a common discharge manifold, and then to a common condenser. From the common condenser, the refrigerant passes to a plurality of evaporators, with each of the evaporators being associated with a separate environment to be conditioned. Each of the evaporators is associated with one or several of the plurality of compressors. By utilizing the common condenser, yet a plurality of evaporators, the ability to independently condition a number of sub-environments is achieved without the requirement of the same plurality of complete separate refrigerant circuits for each compressor. In particular, the economizer circuit provides additional capacity to any of the evaporators that have a relatively high load while the reheat coil provides improved dehumidification. Various design schematics and system configurations are disclosed.

47 Claims, 4 Drawing Sheets

HYBRID TANDEM COMPRESSOR SYSTEM WITH ECONOMIZER CIRCUIT AND REHEAT FUNCTION FOR MULTI-LEVEL COOLING

BACKGROUND OF THE INVENTION

This application relates to a refrigerant system utilizing tandem compressors sharing a common condenser, but having separate evaporators, and wherein an economizer circuit and a reheat coil are incorporated.

Refrigerant systems are utilized in applications to change the temperature and humidity or otherwise condition the environment. In a standard refrigerant system, a compressor delivers a compressed refrigerant to an outdoor heat exchanger, known as a condenser. From the condenser, the refrigerant passes through an expansion device, and then to an indoor heat exchanger, known as an evaporator. In the evaporator, moisture may be removed from the air, and the temperature of air blown over the evaporator coil is lowered. From the evaporator, the refrigerant returns to the compressor. Of course, basic refrigerant systems are utilized in combination with many configuration variations and optional features. However, the above provides a brief understanding of the fundamental concept.

In more advanced refrigerant systems, a capacity of the air conditioning system can be controlled by the employment of so-called tandem compressors. The tandem compressors are normally connected together via common suction and common discharge manifolds. From a single common evaporator, the refrigerant returns through the common suction manifold to each of the tandem compressors. From the individual compressors the refrigerant is delivered into the common discharge manifold and then into a single common condenser. The tandem compressors are also separately controlled and can be started and shut off independently of each other such that one or both compressors may be running at a time. By controlling which compressors are operating, control over the capacity of the entire system is achieved. Often, the two compressors are selected to have different capacities, such that even greater flexibility in capacity control is provided. Also, tandem compressors may have shutoff valves to isolate some of the compressors from the active refrigerant circuit, when they are shutdown. Moreover, if these compressors operate at different suction pressures, then pressure equalization and oil equalization lines are frequently employed.

One advantage of the tandem compressor is that more capacity control is provided, without the requirement of having each of the compressors operating on a dedicated circuit. This reduces the system cost.

However, certain applications require cooling at various temperature levels. For example, in supermarkets, low temperature (refrigeration) cooling can be provided to a refrigeration case by one of the evaporators connected to one compressor and intermediate temperature (perishable) cooling can be supplied by another evaporator connected to another compressor. In another example, a computer room and a conventional room would also require cooling loads provided at different temperature levels, which can be achieved by the proposed multi-temp system as desired. However the cooling at different levels will not work with an application of a standard tandem compressor configuration, as it would require the application of a dedicated circuit for each cooling level. Each circuit in turn must be equipped with a dedicated compressor, dedicated evaporator, dedicated condenser, dedicated expansion device and dedicated evaporator and condenser fans. This arrangement having a dedicated circuitry for each temperature level would be extremely expensive.

In addition, a technique known as an economizer circuit has been utilized in refrigerant systems. The economizer circuit increases the capacity and efficiency of a refrigerant system. To this point, a system having a common condenser communicating with several evaporators has not been utilized in combination with any economizer circuit. Notably, applicants have a co-pending application, filed on even date herewith, entitled "Refrigerant Cycle With Tandem Compressors for Multi-Level Cooling, and assigned Ser. No. 10/975,887.

In some cases, while the system is operating in a cooling mode, the temperature level at which the air is delivered to provide comfort environment in a conditioned space may need to be higher than the temperature that would provide the ideal humidity level. Generally, the lower the temperature of the evaporator coil is the more moisture can be removed from the air stream. These opposite trends have presented challenges to refrigerant system designers. One way to address such challenges is to utilize various schematics incorporating reheat coils. In many cases, a reheat coil placed in the way of an indoor air stream behind the evaporator is employed for the purposes of reheating the air supplied to the conditioned space after it has been cooled in the evaporator, where the moisture has been removed as well.

While reheat coils have been incorporated into air conditioning systems, they have not been utilized in an air conditioning system having an ability to operate at multiple temperature levels by employing tandem compressors, with at least one of the tandem compressors operating in conjunction with the economizer circuit.

SUMMARY OF THE INVENTION

For the simplest system that has only two compressors, in this invention, as opposed to the conventional tandem compressor system, there is no common suction manifold connecting the tandem compressors together. Each of the tandem compressors is connected to its own evaporator; while, both compressors are still connected to a common discharge manifold and a single common condenser. Consequently, for such tandem compressor system configurations, additional temperature levels of cooling, associated with each evaporator, become available. An amount of refrigerant flowing through each evaporator can be regulated by flow control devices placed at the compressor suction ports, as well as by controlling related expansion devices or utilizing other control means, such as evaporator airflow. In addition, in this application, an economizer circuit is incorporated into the refrigerant system. The economizer circuit maybe utilized with one or several of the evaporators. In particular, the economizer circuit may increase the capacity of each evaporator, and thus it would preferably be utilized (to obtain the most benefits) with the evaporator associated with the environment that must be controlled at the lowest temperature.

In addition, a single or multiple reheat coils are associated with one or several evaporators. The reheat coils may be positioned in a parallel or serial flow relationship with an economizer heat exchanger and condenser and can be located either upstream or downstream of each heat exchanger.

In embodiments, only one or several of the evaporators may be associated with the economizer circuit. In the economizer circuit, a portion of the refrigerant is then returned to an intermediate compression position in at least one of the compressors and can be tapped from the main circuit either upstream or downstream of the economizer heat exchanger, as known. Also, the teachings of this invention can be equally applied to compressors connected in series or economized compressors having multiple injection ports.

These and other features of the present invention can be best understood from the following specification and drawings, the following of which is a brief description.

DETAILED DESCRIPTION OF THE PREFERRED EMBODIMENT

Figure 1:
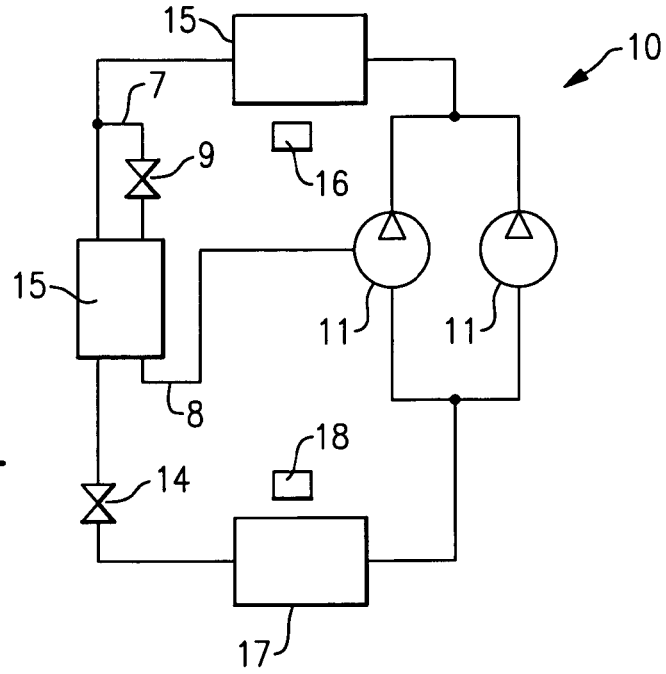
FIG. 1 shows an earlier system.

Referring to FIG. 1, earlier tandem compressor system 10 is shown to include two separate compressors 11, a common evaporator 17, condenser 15, expansion device 14, condenser air-moving device 16, evaporator air-moving device 18 and associated piping. An economizer circuit has an economizer heat exchanger 15 receiving a main refrigerant flow and a tapped refrigerant flow in line 7. As known, the tapped refrigerant flow passes through an expansion device 9 to be expanded to lower pressure and temperature. Downstream of the economizer heat exchanger 15, the tapped flow is returned through a line 8 to an intermediate point in at least one of the compressors 11. Such a system was disclosed in a prior U.S. patent application Ser. No. 10/769,161, filed 30 Jan. 2004, entitled "Refrigerant Cycle With Tandem Economized and Conventional Compressors" and assigned to the assignee of the present invention. As known, the tap line 7 may also be located downstream of the economizer heat exchanger 15.

Figure 2:
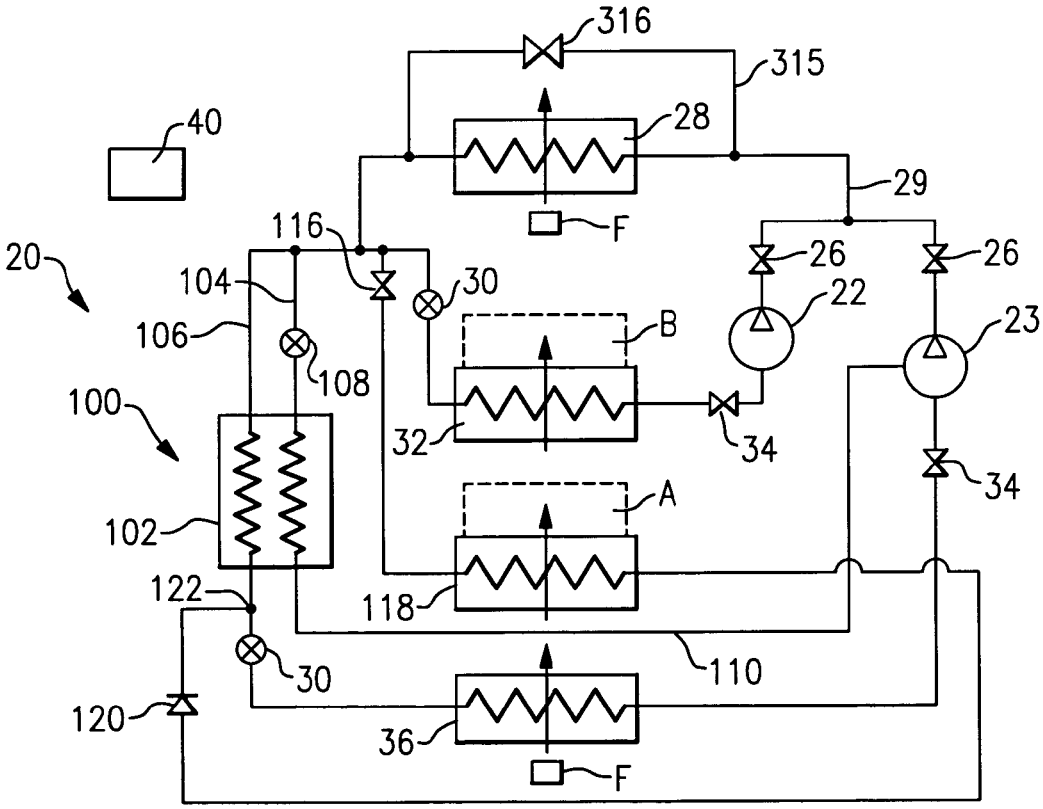
FIG. 2 is a first schematic.

A refrigerant system 20 is illustrated in FIG. 2 having a pair of compressors 22 and 23 that are operating generally as tandem compressors. Optional discharge valves 26 are positioned downstream of these compressors on discharge lines associated with each of the compressors 22 and 23. These valves can be controlled to prevent backflow of refrigerant to either of the compressors 22 or 23 should only one of the compressors be operational. That is, if for instance the compressor 22 is operational with the compressor 23 stopped, then the discharge valve 26 associated with compressor 23 will be closed to prevent flow of refrigerant from the compressor 22 back to the compressor 23. The two compressors communicate with a discharge manifold 29 leading to a common condenser 28. From the condenser 28, the refrigerant continues downstream and is split into two flows, each heading through an expansion device 30. From the expansion device 30, one of the flows passes through a first evaporator 32 for conditioning a sub-environment B. The refrigerant passing through the evaporator 32 passes then through a suction modulation valve 34, and is returned to the compressor 22. The second refrigerant flow passes through an evaporator 36 that is conditioning a sub-environment A. The refrigerant also passes through an optional suction modulation valve 34 downstream of the evaporator 36 and is returned to the compressor 23. An air-moving device F drives air over the evaporator 32 and another air-moving device F drives air over the evaporator 36 and into their respective sub-environments. Usually, sub-environments A and B are preferably maintained at different temperature levels.

A control 40 for the refrigerant system 20 is operably connected to control the compressors 22 and 23, the expansion devices 30, the discharge valves 26, and suction modulation valves 34. By properly controlling each of these components in combination, the conditions at each evaporator 32 and 36 can be controlled as necessary for the sub-environments A and B. The exact controls necessary are as known in the art, and will not be explained here. However, the use of the tandem compressors 22 and 23 utilizing the common condenser 28 and separate evaporators 32 and 36, preferably operating at different temperature levels, reduces the number of components necessary for providing the independent control for the sub-environments A and B, and thus is an improvement over the prior art.

As shown in FIG. 2, an economizer circuit 100 is incorporated into the refrigerant system 20. An economizer heat exchanger 102 receives a refrigerant from an economizer tap 104 and a main refrigerant flow line 106. Notably, the refrigerant heading to the evaporator 32 does not pass through the economizer heat exchanger 102, while the refrigerant heading to the evaporator 36 does. In this embodiment, the evaporator 36 and its sub-environment A is preferably the environment that must be maintained at a lower temperature. The use of the economizer circuit will provide additional cooling capacity for the evaporator 36, as known. The refrigerant passing through the tap 104 passes through an expansion device 108 to be expanded to lower pressure and temperature. This refrigerant thus subcools the refrigerant in the main flow line 106 in the economizer heat exchanger 102. The tapped refrigerant, having been expanded and passed through the economizer heat exchanger 102, returns through a return line 110 to an intermediate compression point in at least one of the compressors, shown here as compressor 23. Notably, while the flow in the lines 104 and 106 are shown in the same direction through the economizer heat exchanger 102, for all of the embodiments in this invention, it is preferred that these two flows are arranged in a counter-flow relationship, however, they are shown in the same direction for illustration simplicity.

The use of the economizer circuit 100 provides additional cooling capacity to the refrigerant system 20.

For this embodiment, and for all other disclosed embodiments, there is an option where the control can also selectively open the economizer expansion device to either allow flow through the economizer heat exchanger, or to block flow through the economizer heat exchanger. When the economizer expansion device is shut off, refrigerant would still pass through the economizer heat exchanger through the main flow line, however, the economizer function would not be operational. Rather than having a single economizer expansion device that also operates as a shut-off valve, two distinct flow control devices could be utilized. Also, as mentioned above, the tap refrigerant line 104 may be located downstream of the economizer heat exchanger 102, providing similar benefits.

In addition, a reheat circuit is incorporated into the system 20. In particular, the reheat circuit includes a flow control device 116 for selectively tapping a refrigerant through a reheat coil 118 associated with the sub-environment A. When the control 40 determines that a reheat function is desired, the valve 116 will be opened and refrigerant will pass through the reheat coil 118, through a check valve 120, and be returned at point 122 to the main refrigerant circuit, upstream of one of the expansion devices 30. At least a portion of air driven by the air-moving device F over the evaporator 36 will also now pass over the reheat coil 118. As is known, this air can be cooled in the evaporator 36, and in particular cooled to a lower temperature by employment of the economizer circuit 100, such that greater dehumidification can be achieved. If the temperature of the air having passed over the evaporator 36 is lower than would be desired in the sub-environment A, then the reheat coil 118 is utilized to heat the air to a desired temperature level after the moisture has been removed in the evaporator 36.

Obviously, the economizer heat exchanger 102 and reheat coil 118 can be associated with different evaporators 32 and 36 if desired. Furthermore, although a warm liquid approach (with the reheat coil 118 located downstream of the condenser 28 and arranged in a parallel relationship with the economizer heat exchanger 102) is shown in FIG. 1, any reheat concept (e.g. hot gas, warm liquid, two-phase mixture) as well as reheat circuit configuration and relative position can be employed, providing similar system advantages in flexibility and control of satisfying a wide spectrum of potential applications and various external sensible and latent load demands. Thus, in systems employing such reheat concepts, the position of the reheat coil in the refrigerant circuit in relation to the condenser 28 and economizer heat exchanger 102 may be sequential or parallel as well as upstream or downstream.

As shown in FIG. 2, a bypass line 315 may bypass refrigerant around the condenser 28 when a flow control device such as valve 316 is opened. This bypass may be selectively utilized by the control 40 when dehumidification is desired with a lower sensible cooling load. Such bypasses are known in the art, and a worker of ordinary skill in this art would recognize how to incorporate this feature into the schematic 20, and when to utilize the feature.

Figure 3A:
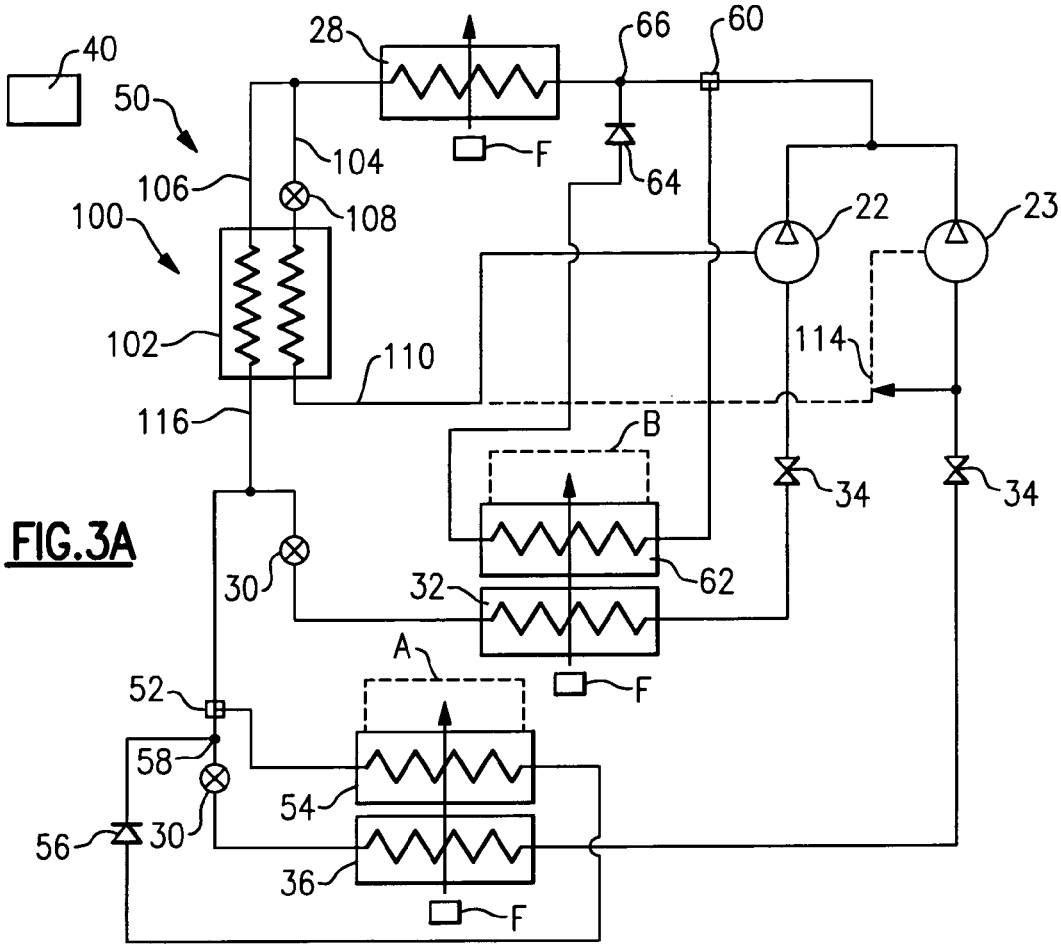
FIG. 3A is a second schematic.

FIG. 3A shows another embodiment 50 that is quite similar to the embodiment 20 of FIG. 2. However, the refrigerant flowing to both of the evaporators 32 and 36 passes through the economizer heat exchanger 102. As shown, the main flow of refrigerant 106 leads to a downstream manifold 116, which then breaks into branches leading to both evaporators 32 and 36. The benefits of additional capacity are thus provided to both of the evaporators. As shown, the refrigerant being returned to the compressor 22 would still return through the line 110. An optional line 114 may also return refrigerant to the other compressor 23, if this compressor is equipped with intermediate injection port as well.

Figure 3B:
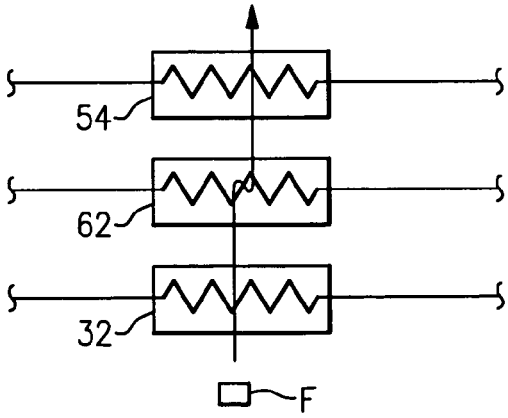
FIG. 3B shows another option.

Reheat coils are also incorporated into the refrigerant cycle 50. Here, a first three-way valve 52 is positioned downstream of the economizer heat exchanger 102, and directs refrigerant through a first reheat coil 54 associated with the evaporator 36 and sub-environment A when a reheat function desired. Refrigerant flowing through the reheat coil 54 then passes through a check valve 56, and is returned at point 58 to the main circuit refrigerant line, upstream of the expansion device 30. In this case, a warm liquid approach is utilized once again, but now with the reheat coil 54 located downstream of both condenser 28 and economizer heat exchanger 102. A second three-way valve 60 selectively taps refrigerant off of a main refrigerant line, and passes it through a second reheat coil 62 associated with the sub-environment B. Refrigerant flowing through the reheat coil 62 then passes through a check valve 64 and is reconnected at point 66 to the main refrigerant line. Here, a hot gas design is employed with the reheat coil 62 positioned upstream of the condenser 28. The control 40 will selectively operate each of the reheat coils dependent on the desired humidification and temperature needs of the sub-environments A and B. As shown in FIG. 3B, both reheat coils 54 and 62 can be associated with a single evaporator (32 or 36) and consequently with a respective sub-environment (B or A), providing multiple reheat stages for this sub-environment. Although the reheat coils 54 and 62 are shown in series (one behind the other) relative to the air path, a parallel configuration is also feasible.

Figure 4:
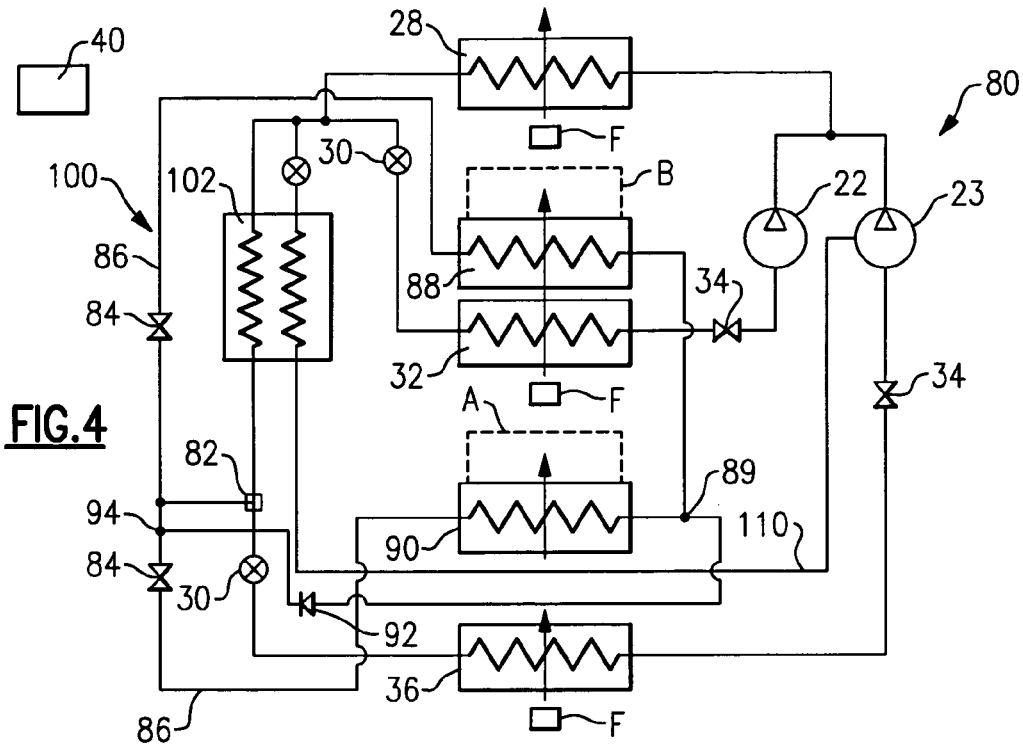
FIG. 4 is a third schematic.

FIG. 4 shows a refrigerant cycle 80, wherein, once again, there are reheat coils associated with each of the two sub-environments A and B. However, in this embodiment, a single three-way valve 82 is positioned downstream of the main flow line passing through the economizer heat exchanger 102. Refrigerant having been tapped from the three-way valve 82 passes to a connection 94, through two lines 86, and selectively operable flow control devices 84, can pass to the two reheat coils 88 and 90. These two refrigerant flows recombine at a point 89, pass through a check valve 92, and are reconnected at the point 94 upstream of the expansion device 30. Thus, in this relationship, the two reheat coils 88 and 90 are in generally parallel configuration such that the refrigerant conditions at the entrance to the reheat coils is generally the same. The control 40 will selectively operate both flow control devices 84 associated with the reheat coils 88 and 90 to be either open or closed to provide refrigerant flow to each of reheat coils associated with sub-environment B and A respectively when the reheat function is desired in each sub-environment. Obviously, the flow control devices can be of an adjustable type to control amount of refrigerant to each reheat coil through modulation or pulsation. As it would be recognized by a worker ordinarily skilled in the art, other parallel configurations of the reheat coils are also feasible.

Figure 5:
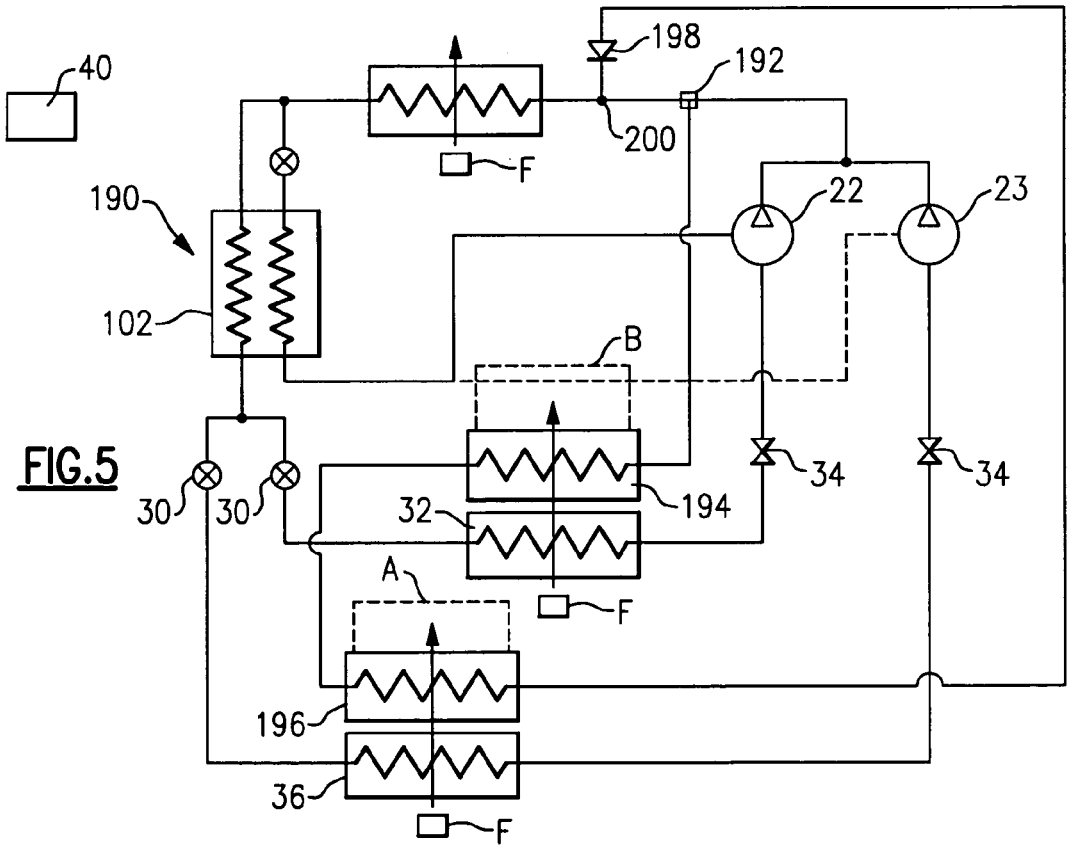
FIG. 5 is a fourth schematic.

FIG. 5 shows an embodiment 190 where the two reheat coils are in a serial flow relationship. A three-way valve 192 taps refrigerant through a first reheat coil 194 associated with the sub-environment B, and the refrigerant then passes downstream serially to a reheat coil 196 associated with the sub-environment A. The refrigerant then passes through a check valve 198, and is reconnected at a point 200 to the main refrigerant flow. As can be appreciated, the refrigerant will have a higher temperature at the reheat coil 196 than it would at the reheat coil 194, and thus the selection of which sub-environment A and B should first receive the refrigerant flow should be made based upon which sub-environment requires a higher amount of reheat. As it would be recognized by a worker ordinarily skilled in the art, other serial arrangements of the reheat coils are also feasible.

Figure 6:
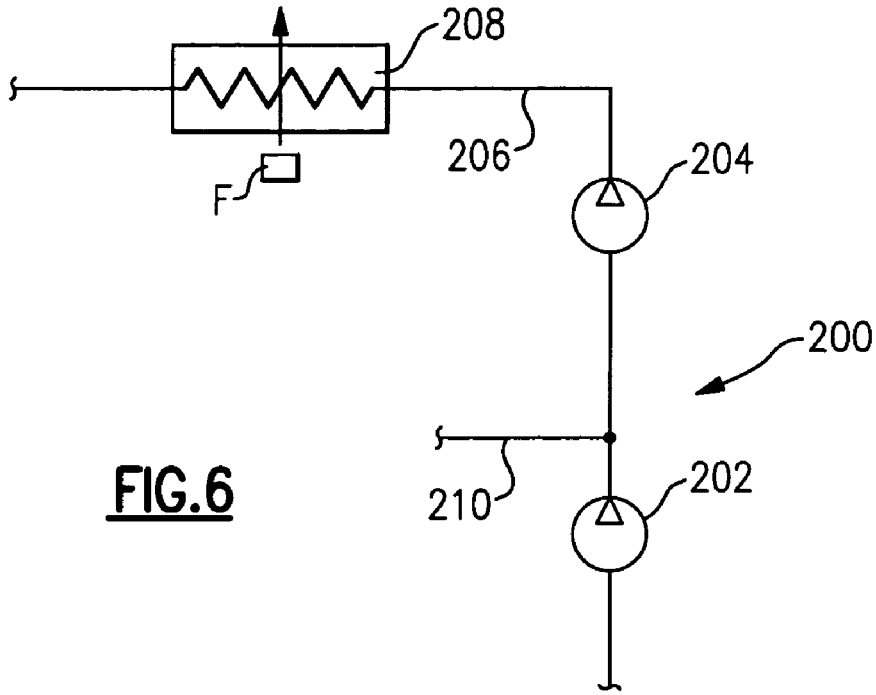
FIG. 6 illustrates another option.

FIG. 6 shows yet another schematic 200, wherein there are serially connected compressors 202 and 204 (instead of a single economized compressor). A discharge line 206 downstream of the second stage compressor 204 delivers refrigerant to a condenser 208. A refrigerant line 210 downstream of the first stage compressor 202 accepts refrigerant from the economizer heat exchanger at an intermediate pressure level. Obviously, any economized compressor can be substituted by a serially connected compressor stages and more than two sequential compressor stages can be employed as well if desired.

Figure 7:
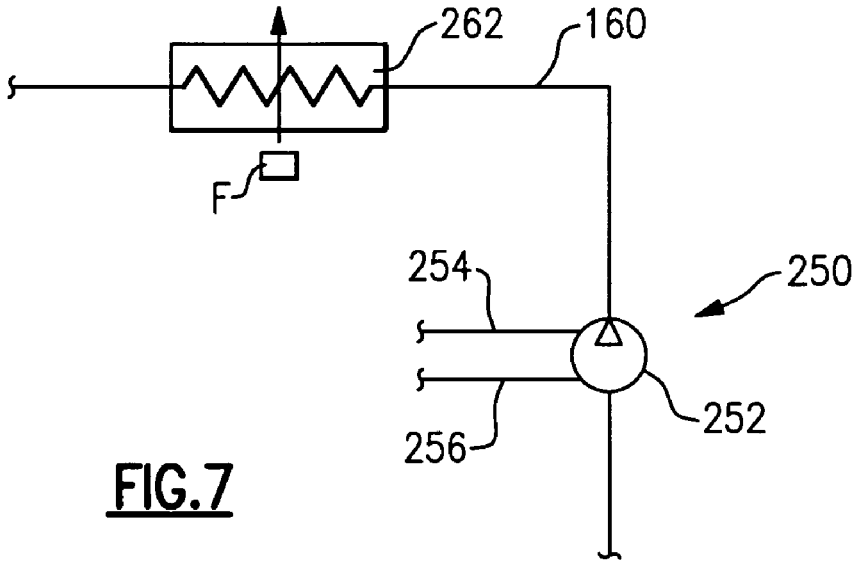
FIG. 7 illustrates yet another option.

FIG. 7 shows an embodiment 250, having an economized compressor 252, such as mentioned above, wherein there are plural intermediate taps 254 and 256, each connected to a respective economizer heat exchanger operating at a different pressure and temperature level and thus providing different amount of subcooling. Such economizer heat exchangers can be arranged in a sequential or parallel configuration to each other. Of course, more than two taps are feasible.

In all of the disclosed embodiments, the economizer circuit and reheat coils assist in providing the distinct temperatures and humidity levels that are to be achieved by one or several of the evaporators. That is, by providing the economizer circuit and reheat coil, the present invention is better able to meet the temperature and dehumidification goals for a wide spectrum of potential applications as well as sensible and latent load demands.

Other multiples of compressors and compressor banks can be utilized.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a plurality of compressors, where at least two of said compressors deliver a refrigerant to a discharge manifold leading to a common condenser, refrigerant passing through said common condenser, and then expanding into a plurality of evaporators, said plurality of evaporators associated with said plurality of said compressors, where said at least two compressors are connected to separate evaporators of said plurality of evaporators; and an economizer circuit positioned between said common condenser and at least one of said plurality of evaporators, and a reheat coil associated with at least one of said evaporators.

2. The refrigerant system as set forth in claim 1, wherein said economizer circuit includes an economizer heat exchanger, and a main flow of refrigerant passing through said economizer heat exchanger and then passing downstream to less than said plurality of evaporators.

3. The refrigerant system as set forth in claim 2, wherein refrigerant passing downstream of said economizer heat exchanger passes to only one of said evaporators.

4. The refrigerant system as set forth in claim 1, wherein said economizer circuit includes an economizer heat exchanger, and a main flow of refrigerant passing through said economizer heat exchanger and then passing downstream to a plurality of said evaporators.

5. The refrigerant system as set forth in claim 1, wherein said economizer circuit includes a tapped flow of refrigerant that is tapped off of a main flow of refrigerant upstream of an economizer heat exchanger and then passed through an economizer expansion device, and then through said economizer heat exchanger, said tapped flow of refrigerant being returned to an intermediate compression point in at least one of said compressors.

6. The refrigerant system as set forth in claim 1, wherein said economizer circuit includes a tapped flow of refrigerant that is tapped off of a main flow of refrigerant downstream of an economizer heat exchanger and then passed through an economizer expansion device, and then through said economizer heat exchanger, said tapped flow of refrigerant being returned to an intermediate compression point in at least one of said compressors.

7. The refrigerant system as set forth in claim 1, wherein refrigerant that is tapped to flow through said reheat coil bypasses said economizer circuit.

8. The refrigerant system as set forth in claim 1, wherein said reheat coil being positioned sequentially with said condenser.

9. The refrigerant system as set forth in claim 8, wherein said reheat coil is located downstream of said condenser.

10. The refrigerant system as set forth in claim 8, wherein said reheat coil is located upstream of said condenser.

11. The refrigerant system as set forth in claim 1, wherein said reheat coil is arranged to be parallel with said condenser.

12. The refrigerant system as set forth in claim 1, wherein said reheat coil is arranged to be sequential with an economizer heat exchanger.

13. The refrigerant system as set forth in claim 12, wherein said reheat coil is located downstream of said economizer heat exchanger.

14. The refrigerant system as set forth in claim 12, wherein said reheat coil is located upstream of said economizer heat exchanger.

15. The refrigerant system as Set forth in claim 1, wherein said reheat coil is arranged to be parallel with an economizer heat exchanger.

16. The refrigerant system as set forth in claim 1, wherein a bypass line and flow control device allows bypass of refrigerant around said condenser.

17. The refrigerant system as set forth in claim 1, wherein there are a plurality of reheat coils, with each of said reheat coils being associated with one of said plurality of evaporators.

18. The refrigerant system as set forth in claim 17, wherein said plurality of reheat coils are positioned to be in parallel flow relationship.

19. The refrigerant system as set forth in claim 17, wherein said plurality of reheat coils are positioned to be in serial flow relationship.

20. The refrigerant system as set forth in claim 1, wherein there are a plurality of reheat coils associated with at least one of said plurality of evaporators.

21. The refrigerant system as set forth in claim 1, wherein at least one of said compressors having a plurality of intermediate pressure ports, and there being a plurality of economizer heat exchangers in said economizer circuit operated at different temperature levels, and returning refrigerant to a respective one of said several intermediate pressure points.

22. The refrigerant system as set forth in claim 1, wherein at least one of said compressors has several compression stages connected in series.

23. The refrigerant system as set forth in claim 1, wherein a refrigerant flowing to said reheat coil can be adjusted through at least one of modulation and pulsation control.

24. A method of operating a refrigerant system comprising the steps of:

1) providing a refrigerant system including a plurality of compressors where at least two of said compressors delivering refrigerant to a common condenser through a discharge manifold, refrigerant passing from said common condenser to a plurality of evaporators, with each of said evaporator delivering refrigerant to one of said plurality of compressors, and an economizer circuit incorporated into said refrigerant system, said economizer circuit being associated with at least one of said plurality of evaporators such that refrigerant passing to said at least one of said plurality of evaporators has passed through an economizer heat exchanger prior to reaching said at least one of said plurality of evaporators, and providing a reheat coil associated with at least one of said plurality of evaporators; and 2) operating said refrigerant system by independently controlling refrigerant flow to each of said evaporators to achieve a desired condition for an environment conditioned by each of said evaporators, and selectively directing refrigerant through said economizer circuit and selectively passing refrigerant to said reheat coil.

25. The method as set forth in claim 24, wherein refrigerant passing through said economizer heat exchanger being directed to a plurality of said evaporators.

26. The method as set forth in claim 25, wherein refrigerant passing through said economizer heat exchanger is sent to each of said plurality of evaporators.

27. The method as set forth in claim 24, wherein refrigerant passing through said economizer heat exchanger is directed to only one of said evaporators.

28. The method as set forth in claim 24, wherein said economizer circuit includes a tapped flow of refrigerant that is tapped off of a main flow of refrigerant upstream of an economizer heat exchanger and passed through an expansion device, and then through said economizer heat exchanger, said tapped flow of refrigerant being returned to an intermediate compression point in at least one of said compressors.

29. The method as set forth in claim 24, wherein said economizer circuit includes a tapped flow of refrigerant that is tapped off of a main flow of refrigerant downstream of an economizer heat exchanger and passed through an expansion device, and then through said economizer heat exchanger, said tapped flow of refrigerant being returned to an intermediate compression point in at least one of said compressors.

30. The method as set forth in claim 24, wherein refrigerant that passes through said reheat coil bypasses said economizer circuit.

31. The method as set forth in claim 24, wherein said reheat coil being positioned sequentially with said condenser.

32. The method as set forth in claim 31, wherein said reheat coil is located downstream of said condenser.

33. The method as set forth in claim 31, wherein said reheat coil is located upstream of said condenser.

34. The method as set forth in claim 24, wherein said reheat coil is arranged to be parallel with said condenser.

35. The method as set forth in claim 24, wherein said reheat coil is arranged to be sequential with said economizer heat exchanger.

36. The method as set forth in claim 35, wherein said reheat coil is located downstream of said economizer heat exchanger.

37. The method as set forth in claim 36, wherein said reheat coil is located upstream of said economizer heat exchanger.

38. The method as set forth in claim 24, wherein said reheat coil is arranged to be parallel with said economizer heat exchanger.

39. The method as set forth in claim 24, wherein there are a plurality of reheat coils, with each of said plurality of reheat coils being associated with one of said plurality of evaporators.

40. The method as set forth in claim 39, wherein said plurality of reheat coils are positioned to be in parallel flow relationship.

41. The method as set forth in claim 39, wherein there are a plurality of reheat coils positioned to be in serial flow relationship.

42. The method as set forth in claim 24, wherein there are a plurality of reheat coils associated with at least one of said plurality of evaporators.

43. The method as set forth in claim 24, wherein at least one of said compressors having a plurality of intermediate pressure ports, and there being a plurality of economizer heat exchangers in said economizer circuit operated at different temperature levels, and returning refrigerant to a respective one of said several intermediate pressure points.

44. The method as set forth in claim 24, wherein at least one of said compressors has several compression stages connected in series.

45. The method as set forth in claim 24, wherein a refrigerant flowing to said reheat coil can be adjusted through at least one of modulation and pulsation control.

46. The refrigerant system as set forth in claim 1, wherein said economizer circuit includes a tapped flow of refrigerant that is tapped off of a main flow of refrigerant, and passed in heat exchange relationship with said main flow of refrigerant in an economizer heat exchanger, and said tapped flow of refrigerant being returned to an intermediate compression point in at least one of said compressors.

47. The refrigerant system as set forth in claim 46, wherein said returned tapped flow of refrigerant not being returned to at least one other of said compressors.

* * * * *